US006890488B2

(12) United States Patent
Mathus et al.

(10) Patent No.: US 6,890,488 B2
(45) Date of Patent: May 10, 2005

(54) APPARATUS FOR SEALING TEST TUBES AND THE LIKE

(75) Inventors: Gregory Mathus, Concord, MA (US); George Lyman, Kennebunkport, ME (US)

(73) Assignee: Matrix Technologies, Inc., Hudson, NH (US)

( * ) Notice: Subject to any disclaimer, the term of this patent is extended or adjusted under 35 U.S.C. 154(b) by 432 days.

(21) Appl. No.: 10/165,032

(22) Filed: Jun. 7, 2002

(65) Prior Publication Data

US 2002/0195448 A1 Dec. 26, 2002

Related U.S. Application Data

(60) Provisional application No. 60/300,295, filed on Jun. 22, 2001.

(51) Int. Cl.[7] ..... B01L 3/00

(52) U.S. Cl. ..... 422/99; 422/102; 422/104

(58) Field of Search ..... 422/99, 102, 104; 206/427, 557, 558; 215/295; 220/253, 255

(56) References Cited

U.S. PATENT DOCUMENTS

| | | | | |
|---|---|---|---|---|
| 4,338,764 A | | 7/1982 | Percarpio | |
| 4,599,314 A | | 7/1986 | Shami | |
| 4,960,219 A | * | 10/1990 | Jordan et al. | 215/354 |
| 5,096,676 A | * | 3/1992 | McPherson et al. | 117/206 |
| 5,112,574 A | | 5/1992 | Horton | |
| 5,721,136 A | * | 2/1998 | Finney et al. | 435/287.2 |
| 6,074,614 A | * | 6/2000 | Hafeman et al. | 422/102 |
| 6,106,783 A | * | 8/2000 | Gamble | 422/102 |
| 6,136,273 A | * | 10/2000 | Seguin et al. | 422/99 |
| 6,241,949 B1 | * | 6/2001 | Kane | 422/102 |
| 6,426,215 B1 | * | 7/2002 | Sandell | 435/305.3 |
| 6,432,694 B1 | * | 8/2002 | Malmqvist | 435/286.5 |
| 6,518,060 B2 | * | 2/2003 | Heimberg et al. | 435/305.3 |
| 6,558,628 B1 | * | 5/2003 | Reo | 422/99 |
| 6,566,144 B1 | * | 5/2003 | Madril et al. | 436/177 |
| 2001/0007642 A1 | * | 7/2001 | Feiglin | 422/102 |

FOREIGN PATENT DOCUMENTS

| | | |
|---|---|---|
| WO | WO 93/01739 | 2/1993 |
| WO | WO 01/17682 | 3/2001 |

* cited by examiner

*Primary Examiner*—Jill Warden
*Assistant Examiner*—Dwayne K Handy
(74) *Attorney, Agent, or Firm*—Gauthier & Connors

(57) ABSTRACT

A sealing mat for sealing the open mouths of an array of test tubes. The mat includes a flexible carrier sheet having an array of mutually spaced pegs projecting downwardly therefrom and a plurality of plugs. The plugs are externally configured and dimensioned to be inserted in and to seal the open mouths of the test tubes. Each of the plugs has an upwardly facing recess internally configured and dimensioned to receive and coact in frictional engagement with a respective one of the pegs to thereby releasably secure the plugs to the carrier sheet. The carrier sheet is separable from the thus inserted plugs by flexure to extract the pegs from the recesses.

7 Claims, 7 Drawing Sheets

APPARATUS FOR SEALING TEST TUBES AND THE LIKE

CROSS REFERENCE TO RELATED APPLICATION

This application claims priority from Provisional patent application Ser. No. 60/300,295 filed Jun. 22, 2001.

BACKGROUND OF THE INVENTION

1. Field of the Invention

This invention relates generally to sealing mats comprising flexible sheets carrying plugs or septums for sealing arrays of test tubes and the like, and is concerned in particular with an improvement in the manner in which the plugs or septums are detachably secured to the carrier sheets.

2. Description of the Prior Art

In a known sealing mat of the type described, for example in WO 01/17682 A1 (Wijnschenk), a matrix of hole is punched through a thin flexible carrier sheet. Plugs are then injection molded into the holes of the sheet. The plugs are formed with circular flanges that are grooved to accept edge portions of the holes, resulting in the plugs being -detachably secured to the sheet.

There are several drawbacks with this approach. The attachment of the plugs to the carrier sheet is somewhat tenuous, thus raising the risk of premature plug separation if the carrier sheet is inadvertently flexed. The plug flanges are weakened by the grooves provided to straddle the edge portions of the holes in the sheet. This in turn can result in the plugs being forced into the tubes when they are being pierced by aspiration needles. The weakened flanges also make it more difficult to remove the plugs from the tubes.

OBJECTIVES AND SUMMARY OF THE INVENTION

An objective of the present invention is to releasably yet reliably secure the plugs to the carrier sheet in a manner that avoids premature separation prior to the plugs being sealingly inserted into the open mouths of test tubes.

A companion objective of the present invention is to ease the release of the carrier sheet from the plugs once the plugs have been inserted into the test tubes.

Still another objective of the present invention is to secure the plugs to the carrier sheet in a manner that does not compromise the structural integrity of the external plug flanges.

In accordance with the present invention, a flexible carrier sheet is provided with an array of downwardly projecting mutually spaced pegs. Plugs are externally configured and dimensioned to be inserted in and to seal the open mounts of an array of test tubes. The plugs have robust peripheral flanges surrounding centrally located and upwardly facing recesses. The recesses are internally configured and dimensioned to receive and coact in frictional engagement with the pegs on the carrier sheet. The carrier sheet is separable from thus inserted plugs by flexure causing the pegs to be progressively extracted from the plug recess.

These and other objects, features and advantages of the present invention will now be described in greater detail with reference to the accompanying drawings, wherein:

DETAILED DESCRIPTION OF PREFERRED EMBODIMENTS

Figure 1:
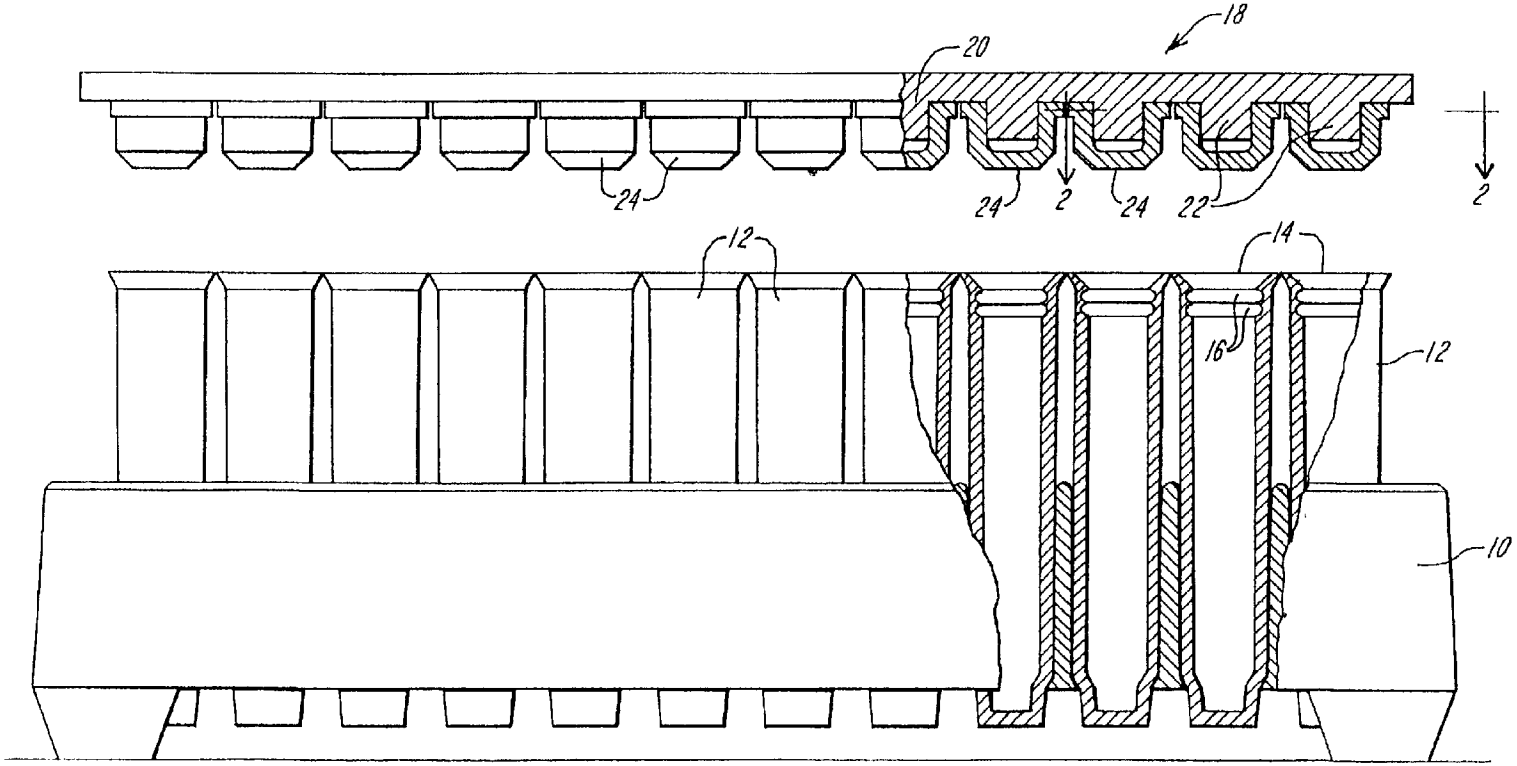
FIG. 1 is a partially broken away side view of a typical test tube rack containing an array of test tubes, with a sealing mat in accordance with one embodiment of the present invention positioned thereabove.

With reference initially to FIGS. 1–6, a conventional test tube rack 10 is shown containing an array of test tubes 12. Each test tube has an open upper end or mouth 14 which may be internally grooved as at 16.

A sealing mat in accordance with one embodiment of the present invention is generally depicted at 18. The sealing mat comprises a flexible carrier sheet 20 with an array of mutually spaced pegs 22 protruding from the bottom thereof. The pegs 22 may have a square configuration, as shown, and are arranged in an array substantially matching that of the test It tubes 12 in the rack 10.

The carrier sheet 20 and pegs 22 may be integrally molded of any appropriate semi-rigid material, including high or medium impact styrene, polycarbonate, vinyl, acrylonitrile-butadene-styrene copolymer ("ABS"), polyethylene terephthalate glycol ("PETG"), etc. Alternatively, the carrier sheet may be manufactured of an appropriate material to create the holding pegs and then laminated to a material that provides the desired amount of semi rigidity.

Externally flanged plugs 24 are releasably secured to the carrier sheet 20. The plugs 24 are exteriorly configured with robust peripheral collars or flanges 26, cylindrical side walls 28 and tapered noses 30. The plugs are cored as at 32 to provide circular upwardly facing recesses 36 configured and dimensioned to receive the pegs 22 protruding from the underside of the carrier sheet 20.

Figure 1A:
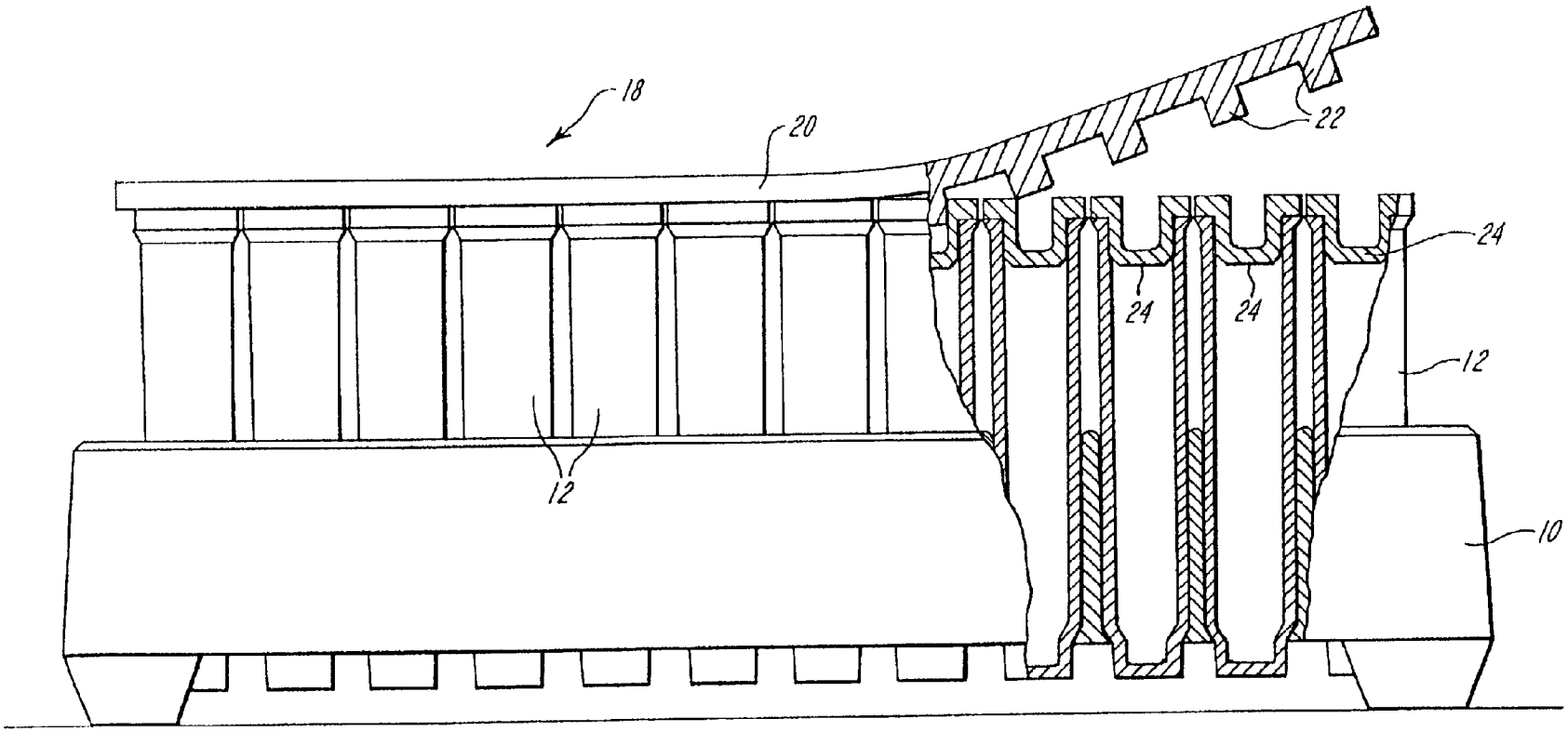
FIG. 1A is a view similar to FIG. 1 showing the test tubes sealed with the plugs, with the carrier sheet being stripped away.
Figure 3:
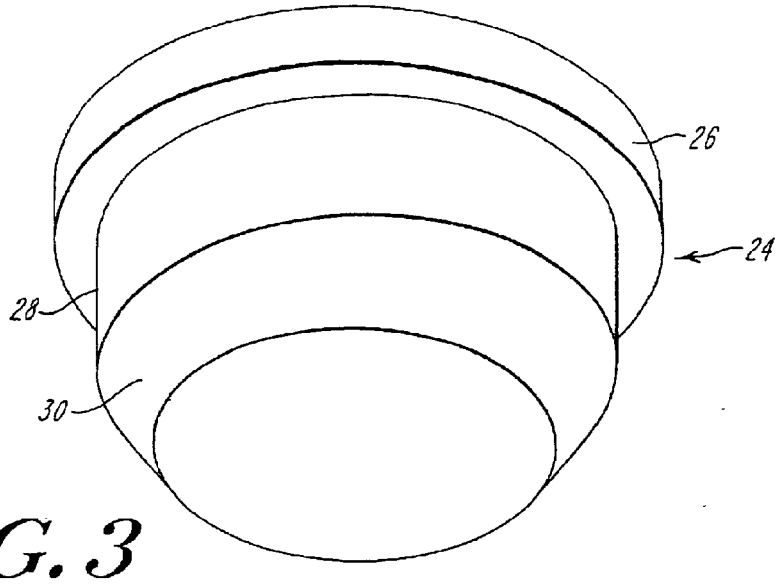
FIG. 3 is a bottom perspective view of a typical plug of the type shown in FIGS. 1, 1A and 2.
Figure 4:
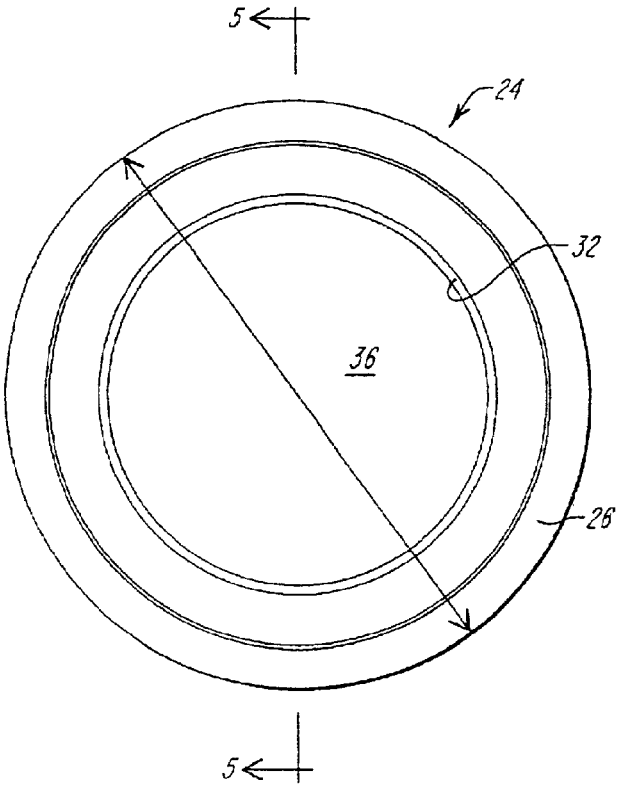
FIG. 4 is a top plan view of the plug.
Figure 5:
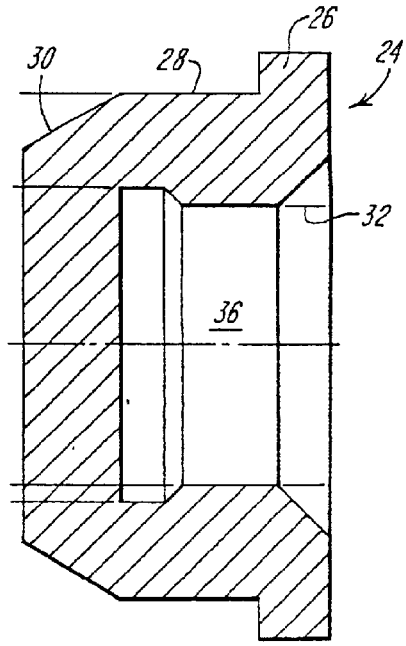
FIG. 5 is a sectional view taken along line 5—5 of FIG. 4.
Figure 6:
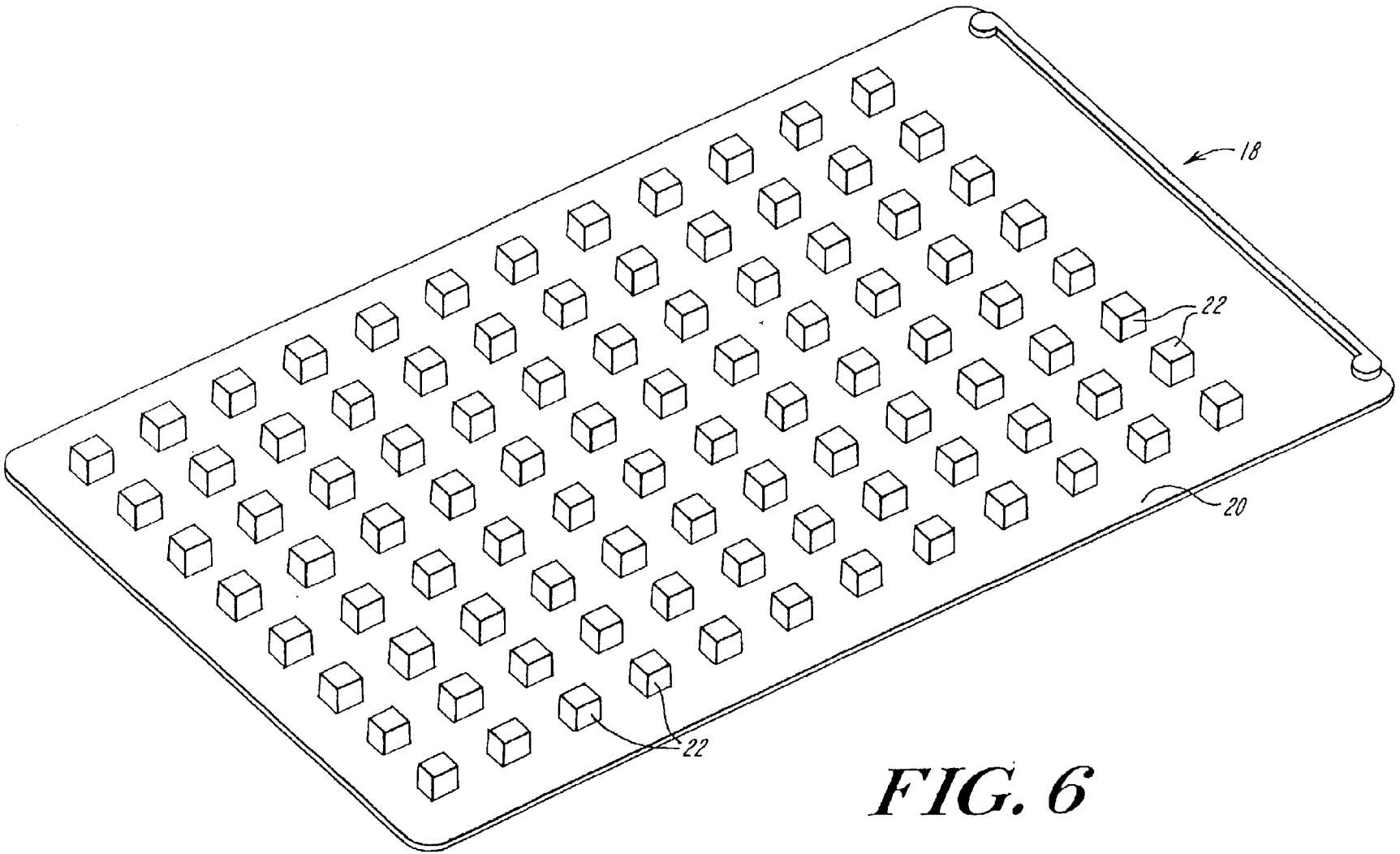
FIG. 6 is an inverted view of the carrier sheet without plugs attached thereto.

The sealing mat 18 with attached plugs 24 is supplied as an assembled unit, as shown in FIG. 1. By simply aligning the plugs with an underlying array of test tubes, and then pressing the mat downwardly, all of the test tubes can be sealed in one convenient application. Thereafter, as shown in FIG. 1A, the carrier sheet can be peeled away from the seated plugs.

Figure 2:
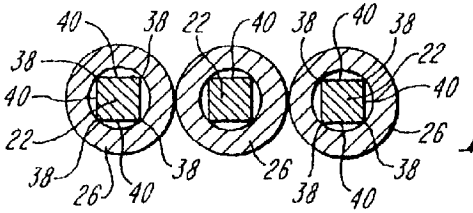
FIG. 2 is a horizontal sectional view taken along line 2—2 of FIG. 1.

As can best be seen in FIG. 2, the pegs 22 coact with the interior recess walls at spaced contact points 38, with open spaces 40 existing between the spaced contact points.

The frictional engagement or interference fit between the pegs 22 and the interior recess walls at the spaced contact points 38 is sufficient to generate the holding power needed to reliably yet releasably connect the plugs to the carrier sheet. As the plugs are inserted into the open mouths of the test tubes, the spaces 40 accommodate any resulting inward radial deflection of the plug walls, thus avoiding an undue increase in the interference fit that might otherwise obstruct extraction of the pegs from the seated plugs when the carrier sheet is peeled away as shown in FIG. 1A. Additionally, the contact area between the interior of each test tube and the exterior of the plug inserted therein is greater in comparison to the contact area between the peg of the carrier sheet and plug recess. This encourages the plugs to remain firmly and securely seated in the test tubes as the carrier sheet is being peeled off.

The plugs may be molded of appropriate thermoplastic elastomers or soft polyolefins, including ethylene propylene, silicone rubber, urethane, etc.

Figure 7:
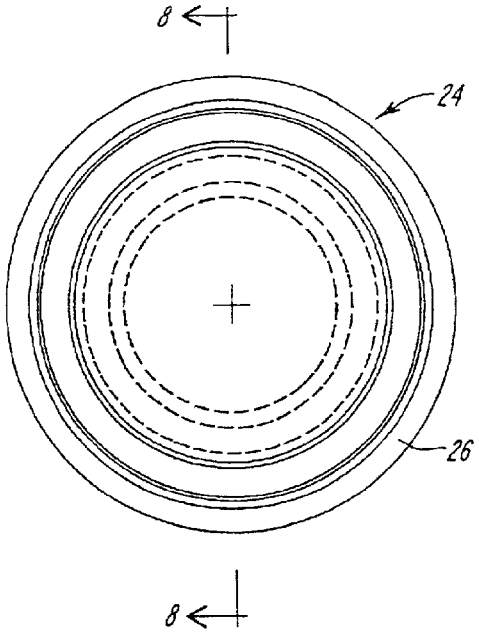
FIG. 7 is a top plan view of an alternative embodiment of a plug in accordance with the present invention.
Figure 8:
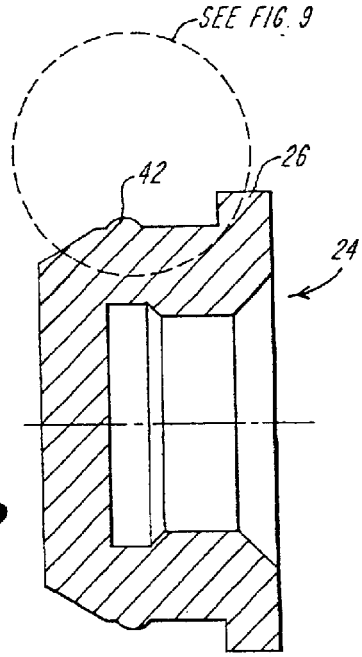
FIG. 8 is a sectional view taken along line 8—8 of FIG. 7.
Figure 9:
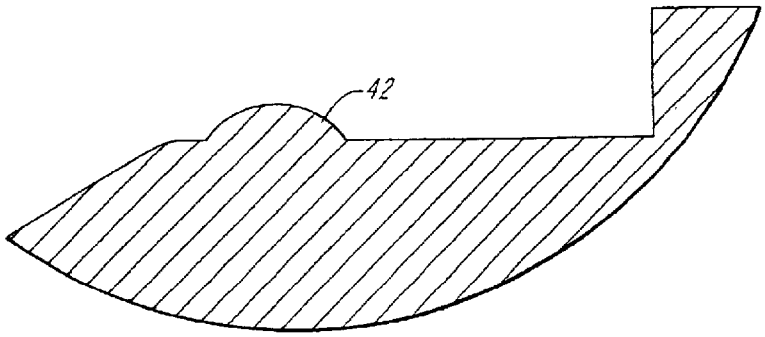
FIG. 9 is an enlarged view of the circled portion of FIG. 8.

As shown in FIGS. 7–9, the plugs 24 may be provided with one or more peripheral beads 42 designed to coact with internal grooves 16 in the upper regions of the test tubes.

Figure 10:
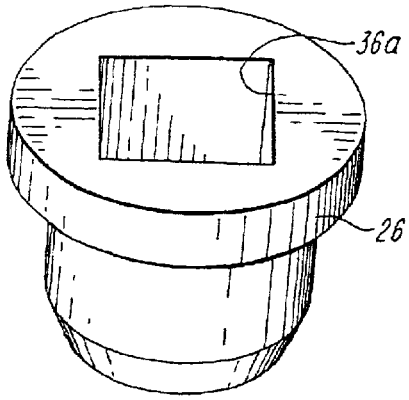
FIGS. 10 and 11 depict alternative configurations for the protruding pegs recesses.
Figure 11:
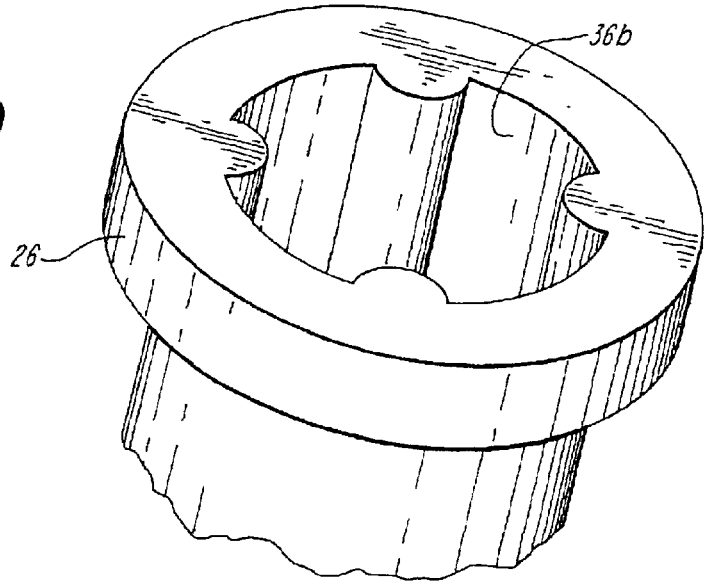
Figure 12:
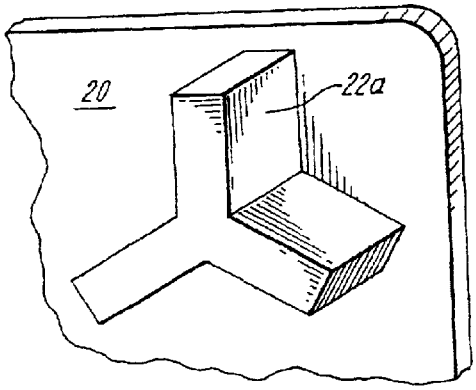
FIGS. 12–15 depict alternative configurations for the protruding pegs on the carrier sheet.
Figure 13:
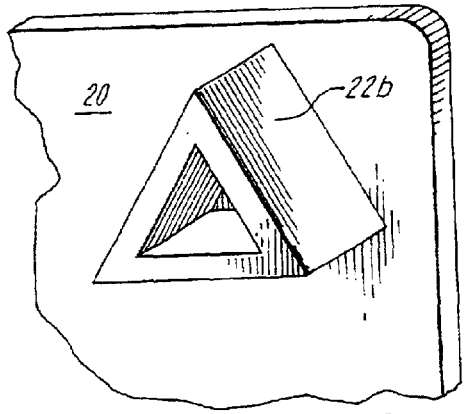
Figure 14:
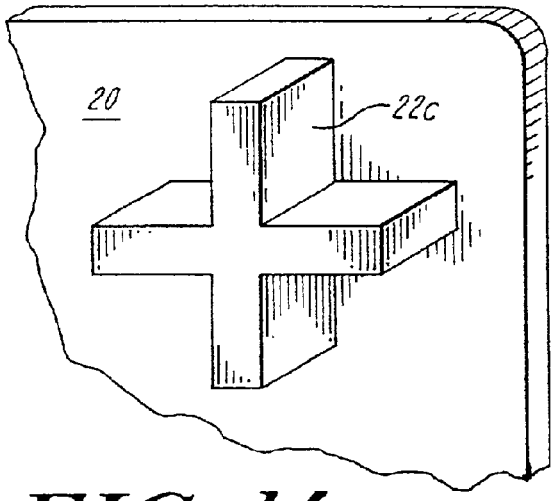
Figure 15:
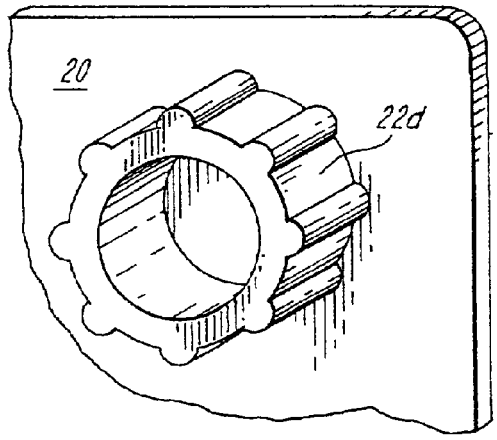

The pegs on the underside of the carrier sheet 20 may take on various configurations, examples of which include Y shapes (22*a* in FIG. 12), triangular shapes (22*b* in FIG. 13), cross shapes (22*c* in FIG. 14) and ribbed cylindrical shapes (22*d* in FIG. 15). The pegs might also be circular, in which event the cored recesses would be non-circular, e.g., square (36*a* in FIG. 10), internally ribbed (36*b* in FIG. 11), etc.

Figure 16:
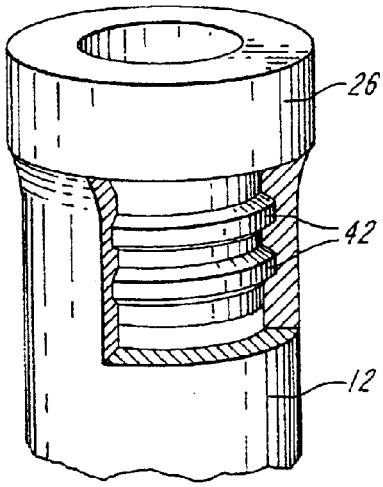
FIG. 16 depicts still another alternative embodiment of a plug and coactively configured test tube.

As shown in FIG. 16, the plugs 24 may also be provided with multiple vertically spaced circumferential beads 42 in order to achieve an enhanced interlocked relationship with the test tubes 12.

The peripheral plug flanges 26 are robust and as such, provide adequate resistance to forces tending to push the plugs down beneath the upper rims of the test tubes. This is particularly advantageous when the plugs are being pierced by aspiration needles and the like. The robust flanges also resist distortion when being pushed or pried upwardly during removal of the plugs from their respective test tubes.

Figure 17:
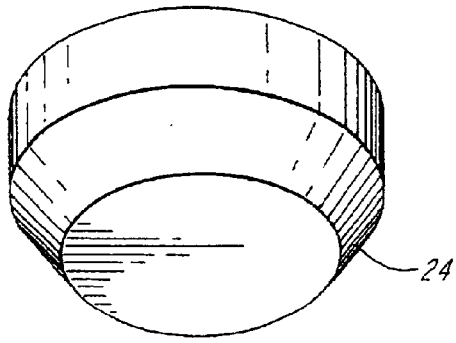
FIG. 17 is a bottom perspective view of an alternative plug.

Alternatively as shown in FIG. 17, the plugs may be provided without external flanges. In such cases, the extent of plug penetration into the test tubes will be limited by contact between the underside of the carrier sheet and the upper rims of the test tubes.

We claim:

1. A sealing mat for sealing the open mouths of an array of test tubes, said sealing mat comprising:

a flexible carrier sheet having an array of mutually spaced pegs projecting downwardly therefrom; and a plurality of plugs, said plugs being externally configured and dimensioned to be inserted in and to seal the open mouths of said test tubes, each of said plugs having an upwardly facing recess internally configured and dimensioned to receive and coact in frictional engagement with a respective one of said pegs to thereby releasably secure said plugs to said carrier sheet, said carrier sheet being separable from the thus inserted plugs by flexure to extract said pegs from said recesses.

2. The sealing mat of claim 1 wherein said pegs and said recesses are configured to coact in frictional engagement at spaced locations separated by open spaces.

3. The sealing mat of claim 1 or 2 wherein circular rims surround the open mouths of said test tubes, and wherein said plugs have peripheral collars arranged to contact said rims and thereby limit the extent to which said plugs may be inserted into said test tubes.

4. The sealing mat of claim 3 wherein said recesses are surrounded by and spaced inwardly from said collar.

5. The sealing mat of claim 1 wherein said plugs have cylindrical side walls terminating in tapered noses.

6. The sealing mat of claim 5 wherein said plugs have peripheral collars projecting radially and externally from said cylindrical side walls.

7. The sealing mat of claim 1 wherein said plugs are provided with circular beads configured to coact with internal grooves in the upper regions of said test tubes.

* * * * *